US011034054B2

(12) United States Patent
Chang et al.

(10) Patent No.: US 11,034,054 B2
(45) Date of Patent: Jun. 15, 2021

(54) PREFABRICATED STAIRS MODULAR ASSEMBLY MOLD AND ASSEMBLING METHOD THEREOF

(71) Applicants: China University of Mining and Technology, Jiangsu (CN); China Mining & Civil New Material Science and Technology Ltd., Jiangsu (CN); BOXIA MINING TECHNOLOGY LTD., Jiangsu (CN)

(72) Inventors: Hong Chang, Jiangsu (CN); Junwu Xia, Jiangsu (CN); Xiaofang Xiang, Jiangsu (CN); Xia Bai, Jiangsu (CN)

(73) Assignees: China University of Mining and Technology, Jiangsu (CN); China Mining & Civil New Material Science and Technology Ltd., Jiangsu (CN); BOXIA MINING TECHNOLOGY LTD., Jiangsu (CN)

( * ) Notice: Subject to any disclaimer, the term of this patent is extended or adjusted under 35 U.S.C. 154(b) by 0 days.

(21) Appl. No.: 17/043,686

(22) PCT Filed: Oct. 8, 2019

(86) PCT No.: PCT/CN2019/109901
§ 371 (c)(1),
(2) Date: Sep. 30, 2020

(87) PCT Pub. No.: WO2020/103584
PCT Pub. Date: May 28, 2020

(65) Prior Publication Data

US 2021/0017775 A1 Jan. 21, 2021

(30) Foreign Application Priority Data

Nov. 20, 2018 (CN) ..... 201811383173.0

(51) Int. Cl.
*B28B 7/22* (2006.01)
*B28B 7/02* (2006.01)
(Continued)

(52) U.S. Cl.
CPC ..... *B28B 7/225* (2013.01); *B28B 7/0014* (2013.01); *B28B 7/02* (2013.01); *E04G 13/062* (2013.01);
(Continued)

(58) Field of Classification Search
CPC .. B28B 7/22; B28B 7/225; B28B 7/02; B28B 7/025; B28B 7/04; B28B 7/0014; B28B 7/0017; E04G 13/06; E04G 13/062
(Continued)

(56) References Cited

U.S. PATENT DOCUMENTS 1,012,735 A * 12/1911 Smock ..... B28B 7/225 249/14
2,161,822 A * 6/1939 Kogl ..... B28B 7/225 249/14
(Continued)

FOREIGN PATENT DOCUMENTS

CN 105442841 3/2016
CN 105952149 9/2016
(Continued)

OTHER PUBLICATIONS

"International Search Report (Form PCT/ISA/210) of PCT/CN2019/109901," dated Jan. 6, 2020, pp. 1-5.

*Primary Examiner* — Michael Safavi
(74) *Attorney, Agent, or Firm* — JCIPRNET

(57) ABSTRACT

A prefabricated stair modular assembly mold comprises a base, a step standard module, an upside module of a lower platform, an underside rotating module of a lower platform, an upside module of an upper platform, an underside rotat-
(Continued)

ing module of an upper platform, an underside common module, and an underside adjustment modules. Prefabricated stair molds of different dimensions are formed by means of locating holes provided in the assembling modules, and are then fixed by means of sliding holes at two ends. Further disclosed is a mounting method for said assembly mold. Said assembly mold has high positioning accuracy, and small accumulated error, improving the mounting efficiency of the prefabricated staircase mold.

7 Claims, 9 Drawing Sheets

(51) Int. Cl.
*E04G 13/06* (2006.01)
*B28B 7/00* (2006.01)
*E04F 11/02* (2006.01)

(52) U.S. Cl.
CPC ..... *E04F 11/02* (2013.01); *E04F 2011/0212* (2013.01)

(58) Field of Classification Search
USPC ..... 249/139
See application file for complete search history.

(56) References Cited

U.S. PATENT DOCUMENTS 2,331,701 A * 10/1943 Kogl ..... B28B 7/225 249/14
2,705,825 A * 4/1955 Dartez ..... B28B 7/225 249/14
2,880,491 A * 4/1959 Varnado, Sr. ..... B28B 7/225 249/14
3,212,155 A * 10/1965 Francis, Jr. ..... B28B 7/225 249/14
3,269,688 A * 8/1966 Hulicki ..... B28B 7/225 249/14
3,836,109 A * 9/1974 Lister ..... B28B 7/225 249/14
8,262,055 B2 * 9/2012 Costello ..... B28B 7/225 249/14
2008/0115429 A1 5/2008 Zirbel et al.
2017/0239838 A1 * 8/2017 Eggleston, II ..... B28B 7/225

FOREIGN PATENT DOCUMENTS

CN 205577406 9/2016
CN 108661321 10/2018
CN 109653495 4/2019
JP 2911572 B2 * 6/1999 ..... E04G 13/06
JP 3404580 B2 * 5/2003 ..... E04G 13/06
KR 20030057257 A * 7/2003 ..... E04G 13/062
TW 391455 5/2000
WO WO-2007011127 A1 * 1/2007 ..... E04F 11/025
WO WO-2018119546 A1 * 7/2018 ..... E04G 13/06
WO WO-2020052071 * 3/2020 ..... B28B 7/225

* cited by examiner

PREFABRICATED STAIRS MODULAR ASSEMBLY MOLD AND ASSEMBLING METHOD THEREOF

CROSS-REFERENCE TO RELATED APPLICATION

This application is a 371 application of the international PCT application serial no. PCT/CN2019/109901, filed on Oct. 8, 2019, which claims the priority benefit of China application no. 201811383173.0, filed on Nov. 20, 2018. The entirety of each of the abovementioned patent applications is hereby incorporated by reference herein and made a part of this specification.

BACKGROUND

Technical Field

The present invention relates to a stairs mold, and specifically, to a prefabricated stairs modular assembly mold and an assembling method thereof, and relates to the technical field of stairs molds.

Description of Related Art

With the process of construction industrialization being vigorously promoted in China, a lot of fabricated concrete structures are being built. The fabricated concrete structure is to manufacture corresponding prefabricated components of a building at the processing plant, and then the prefabricated components are transported to the site for assembly. Fabricated stairs are one of the most common split components in the fabricated concrete structure. Compared with a conventional cast-in-place stairs structure, the fabricated stairs can achieve advantages of short construction duration, high efficiency, and accessibility. However, the current design for the fabricated concrete structure has not reached a forward design, and a conventional design method is mainly used to design the concrete structure and then the concrete structure is split, which causes excessive dimensions of the prefabricated stairs. One stairs mold is required for stairs of one dimension. Therefore, a manufacturer of fabricated components needs to prepare a lot of molds, and molds of a certain specification may be used only once. The increase in mold cost increases running cost of the manufacturer, and is not beneficial to promote the fabricated structure.

SUMMARY

To overcome disadvantages in the prior art, the present invention provides a prefabricated stairs modular assembly mold and an assembling method thereof. A mold may be used to implement assembly of stairs of a plurality of specifications specified in the existing construction standards. In addition, high precision, convenient assembly, and high efficiency are achieved, thereby greatly reducing costs of a manufacturer and effectively shortening construction duration.

To achieve the foregoing objective, a prefabricated stairs modular assembly mold in the present invention includes a base, a step standard module, an upside module of a lower platform, an underside rotating module of a lower platform, an upside module of an upper platform, an underside rotating module of an upper platform, an underside common module, and an underside adjustment module, where:

fixing bolts for assembling the flight modules are provided on the base, and the upside module of the lower platform is the flight module at the bottom, where several fixing holes are provided on a side end-plate connected to the base, several locating holes and sliding holes are provided on a vertical end surface connected to the step standard module above, and several fixing holes are provided on a horizontal end surface connected to the underside rotating module of the lower platform;

for the underside rotating module of the lower platform, several sliding holes are provided on a side end-plate connected to the base, several locating holes and sliding holes are provided on a horizontal end surface connected to the upside module of the lower platform, and several fixing holes are provided on an end surface connected to the underside common module; and the underside rotating module of lower platform includes a horizontal fixing section and a sloping rotation section, where the horizontal fixing section and the sloping rotation section are hinged by using a rotating shaft;

for the step standard module, a sliding slot is provided on a side end portion connected to the base, several fixing holes are provided on a vertical end surface connected to the lower step standard module, and several locating holes and sliding holes are provided on a vertical end surface connected to the upper step standard module;

for the upside module of the upper platform, several fixing holes are provided on a vertical end surface connected to the step standard module, and several fixing holes are provided on a horizontal end surface connected to the lower underside rotating module of the upper platform;

for the underside rotating module of the upper platform, several locating holes and sliding holes are provided on a horizontal end surface connected to the upside module of the upper platform, and several fixing holes are provided on an end surface connected to the underside adjustment module; and the underside rotating module of the upper platform includes a horizontal fixing section and a sloping rotation section, where the horizontal fixing section and the sloping rotation section are hinged by using a rotating shaft; and the adjustment module includes several sections of adjustment plates of different widths, and a length of an underside of the prefabricated stairs is adjusted through different splicing; and the common module is a fixed-length module, and a curved sliding slot is provided on a side end-plate connected to the base.

The upside module of the lower platform determines a step stair dimension by using the locating holes, and is fixed to the upper step standard module by using the sliding holes. The upside module of the lower platform is connected to the base by using the side fixing holes and is connected to the underside rotating module of the lower platform by using the bottom fixing holes. The step standard module determines a step stair dimension by using the locating holes, and is sequentially connected to the step standard modules by using the sliding holes, where the step standard module can move along the sliding slot and be fixed to the base by using bolts. The upper platform upside module is respectively connected to the step standard module and the upper platform underside rotating module by using fixing holes at two ends. The underside rotating module of upper platform determines a horizontal dimension of the upper platform underside by using locating holes, and is connected to the upside module of the upper platform. By rotating the rotating shaft, an angel between the upper platform horizontal plane and the flight incline may be adjusted, and the underside rotating module of the upper platform is connected to the flight underside adjustment module by using fixing holes. The underside rotating module of the lower platform determines a horizontal dimension of the lower platform underside by using locating holes, and is connected to the base and the upside module of the lower platform. An angel between the lower platform horizontal plane and the flight incline is adjusted by using the rotating shaft, and the underside rotating module of the lower platform is connected to the flight underside common module by using fixing holes. The flight underside common module is respectively connected to the underside rotating module of the lower platform and the flight underside adjustment module by using the fixing holes on two sides, moving and rotation of the flight underside common module are implemented by using the curved sliding slots, and the flight underside common module is fixed to the base by using bolts.

Further, horizontal end surfaces of both the upside module of the lower platform and the upside module of the upper platform are provided with reserved holes, a sliding reserved hole is provided on a position that is on the horizontal end surface of the underside rotating module of the lower platform and that corresponds to the reserved hole on the upside module of the lower platform, a sliding reserved hole is provided on a position that is on the horizontal end surface of the underside rotating module of the upper platform and that corresponds to the reserved hole on the upside module of the upper platform; and a pin reserved hole module is provided on the reserved hole between the upside module of the lower platform and the underside rotating module the lower platform, and a pin reserved hole module is provided on the reserved hole between the upside module of the upper platform and the underside rotating module of the upper platform.

The pin reserved hole module is configured to form assembling key slots during vertical casting.

Further, the pilot holes of different heights on the upside module of the lower platform, the step standard module, the underside rotating module of the upper platform, and the underside rotating module of the lower platform respectively correspond to stair dimensions of different specifications, the sliding holes are oblong holes provided on two sides of the locating holes, and a distance between circle centers of two ends of the oblong hole is greater than or equal to a height difference between the highest locating hole and the lowest locating hole.

For prefabricated stairs of different stair specifications, pilot holes of different heights are selected for positioning, and then sliding holes at the two ends are used for assembling and fixing.

Further, a radian and a length of each curved sliding slot on the underside common module are determined according to a moving path of the underside common module.

An assembling method of a prefabricated stairs modular assembly mold includes the following steps:

step one: fixing a side end-plate of an upside module of a lower platform to a base by using bolts;

step two: selecting, according to a selected specification, locating holes with different stair dimensions, sequentially connecting step standard modules from bottom to top, determining a quantity of the step standard modules according to a dimension of fabricated stairs, and fixing a side end-plate of the base of the step standard modules to the base by using bolts;

step three: selecting a uniform stair dimension according to the locating hole on the step standard module, and fixedly connecting an upside module of the upper platform to the last level of step standard module by using bolts;

step four: fixedly connecting the upside module of the upper platform to an underside rotating module of the upper platform according to the locating hole on the underside rotating module of the upper platform by using bolts;

step five: fixing a underside rotating module of the lower platform to the upside module of lower platform according to the locating hole on the upside module of the lower platform by using bolts, and fixing a side end-plate of the underside rotating module to the base by using bolts;

step six: connecting a flight underside common module to the underside rotating module of the lower platform by using bolts;

step seven: selecting a corresponding quantity of flight underside adjustment modules according to a stairs dimension and sequentially connecting the flight underside adjustment modules, where the underside adjustment module at the top is fixedly connected to the underside rotating module of the upper platform by using bolts, and the underside adjustment module at the bottom is fixedly connected to the underside common module by using bolts;

step eight: adjusting an angle by using the upper platform underside rotating module and the lower platform underside rotating module, determining positions of the flight underside common module and the flight underside adjustment modules, and fixing the underside common module to the base by using bolts; and step nine: respectively fixing four pin reserved hole modules to holes on the upside module of the lower platform and the upside module of the upper platform.

The present invention may form prefabricated stairs with different stair dimensions by using locating holes provided on each assembly flight, and then sliding holes on two sides are used for fixing and limiting. Compared with molds that are adjusted by using sliding holes in the prior art, locating precision is higher, an accumulative error is smaller, so that a rework rate is greatly decreased, and assembling efficiency of prefabricated stairs is improved. The underside rotating module of the lower platform and the underside rotating module of the upper platform may perform angle adjustment by using a rotatable rotating shaft connected between them, and curved sliding slots with different lengths are provided on the underside common module to adjust the angle of the stairs, which greatly simplifies an assembling process. In addition, the plane uses underside common module at one end and several underside adjustment modules to meet requirements of stairs with different lengths. By means of position adjustment and quantity change of different modules, fabricated stairs molds of a plurality of dimensions may be assembled, so that that a set of molds can basically meet stairs dimensions of different specifications and models required by the standards, thereby simplifying an assembling procedure, improving assembling precision, reducing manufacturing costs, and shortening construction duration.

DESCRIPTION OF EMBODIMENTS

The following describes the present invention in detail with reference to the accompanying drawings and specific embodiments.

Figure 1:
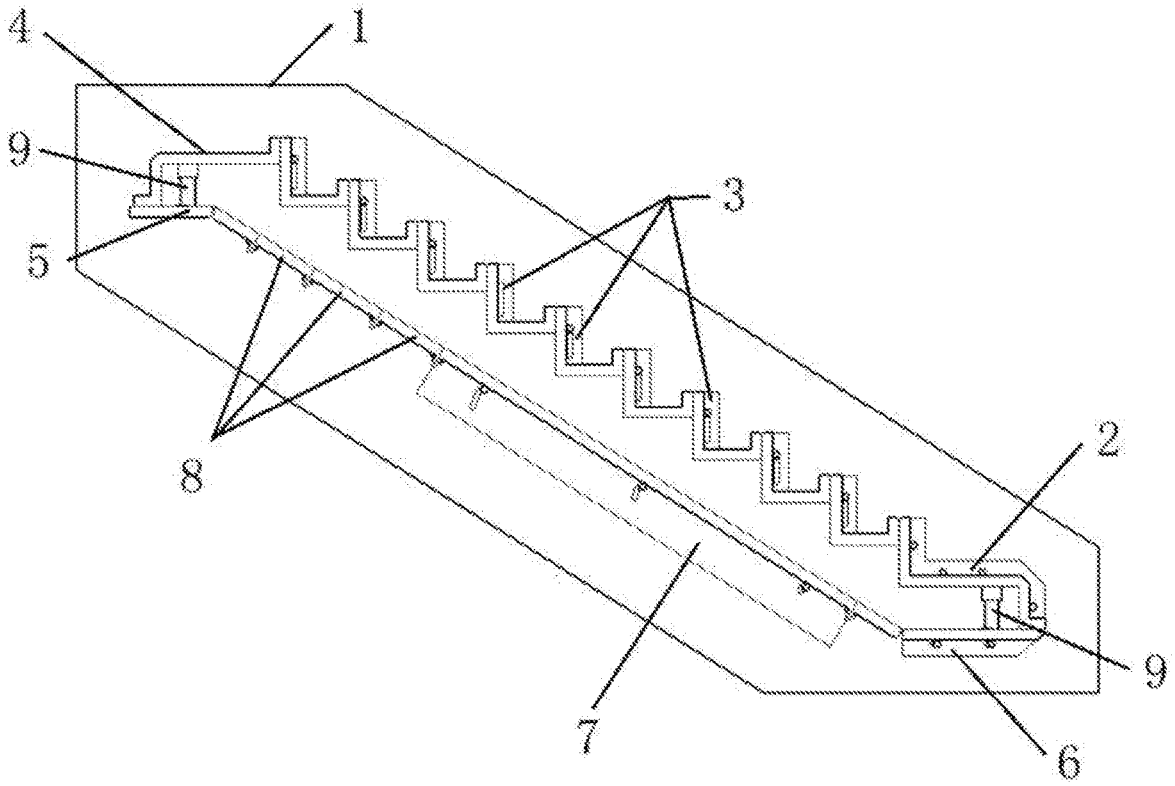
FIG. 1 is a schematic planar structural diagram of an assembled prefabricated stairs mold according to the present invention.
Figure 2:
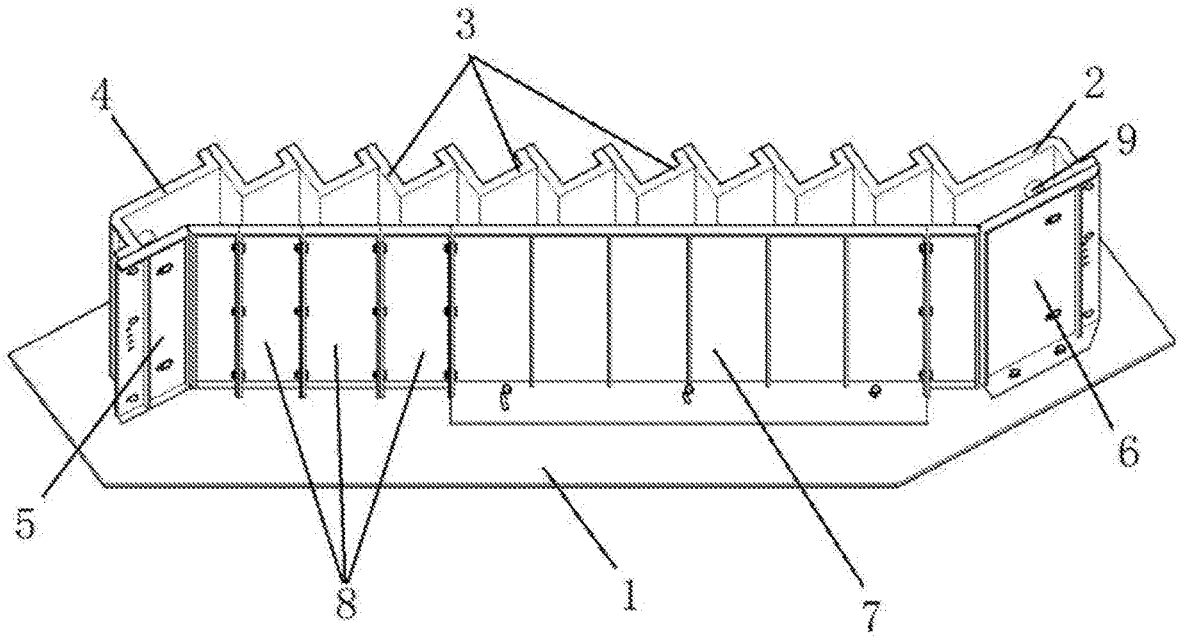
FIG. 2 is a schematic three-dimensional structural diagram of FIG. 1.
Figure 3:
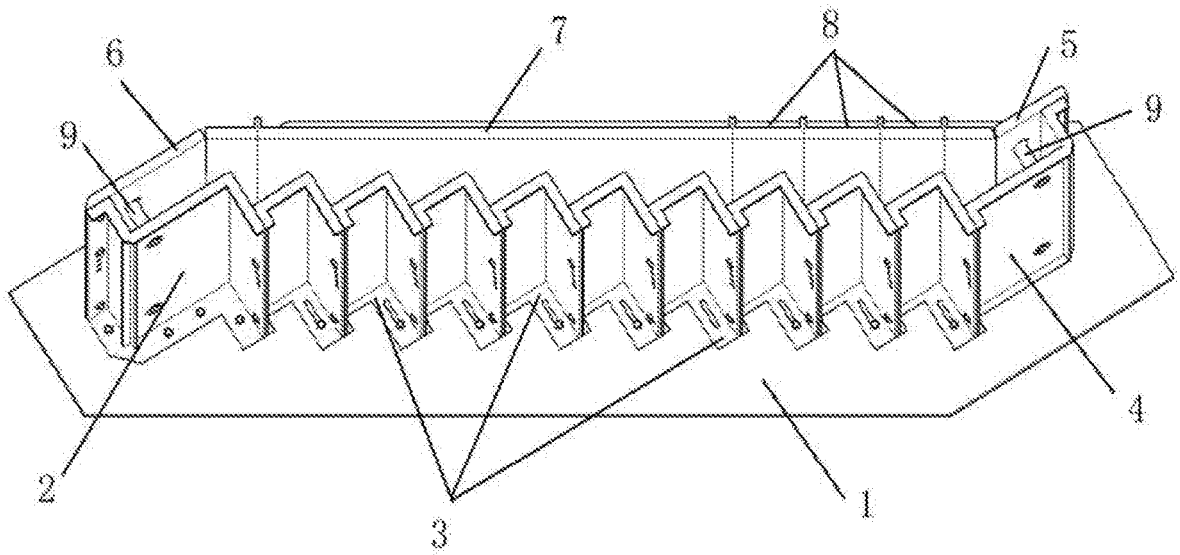
FIG. 3 is a schematic three-dimensional structural diagram of FIG. 1 in another direction.
Figure 4:
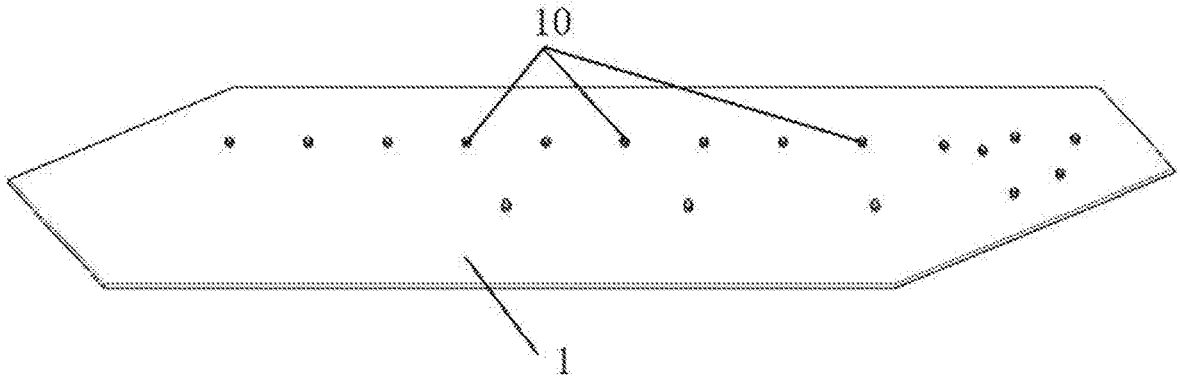
FIG. 4 is a schematic structural diagram of a base according to the present invention.
Figure 5:
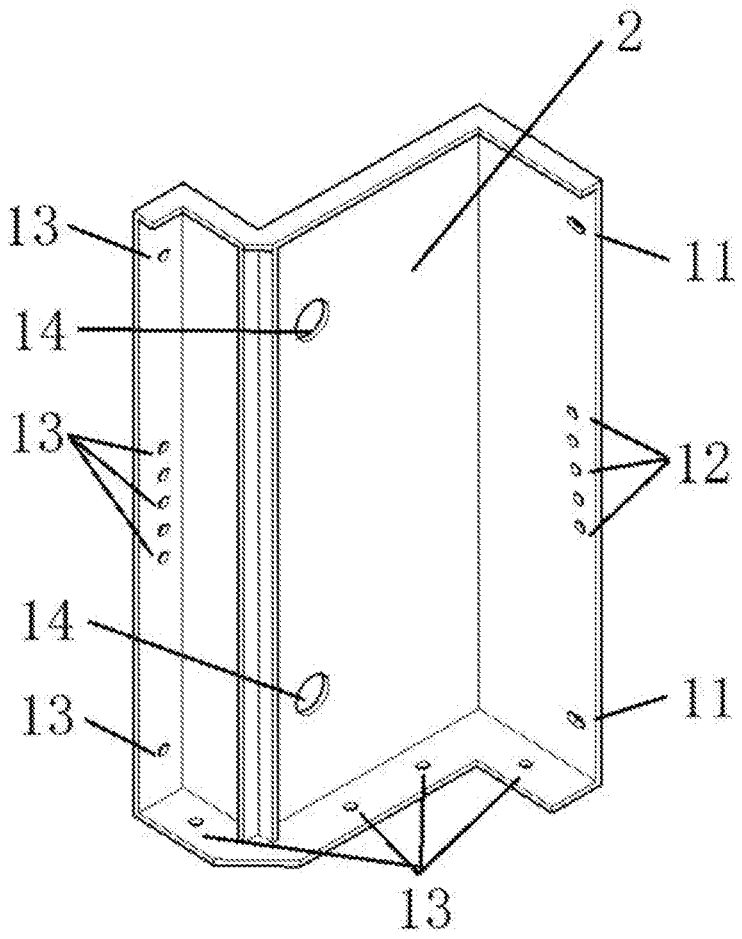
FIG. 5 is a schematic three-dimensional structural diagram of a upside module of a lower platform according to the present invention.
Figure 6:
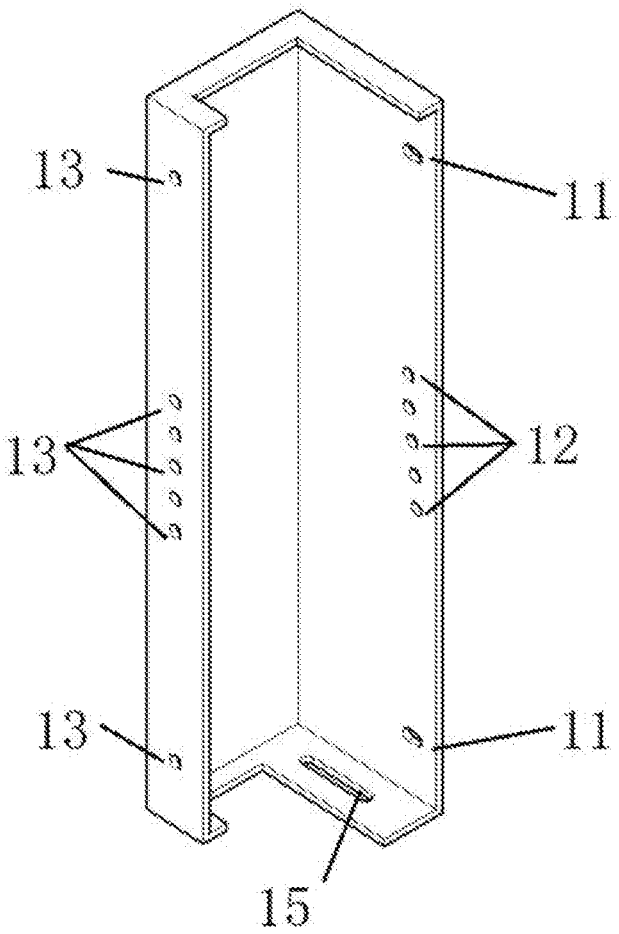
FIG. 6 is a schematic three-dimensional structural diagram of a step standard module according to the present invention.
Figure 7:
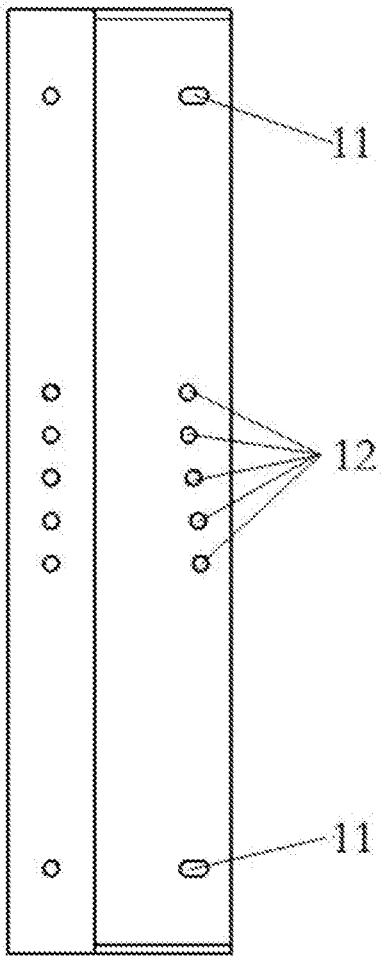
FIG. 7 is a schematic planar structural diagram of FIG. 6.
Figure 8:
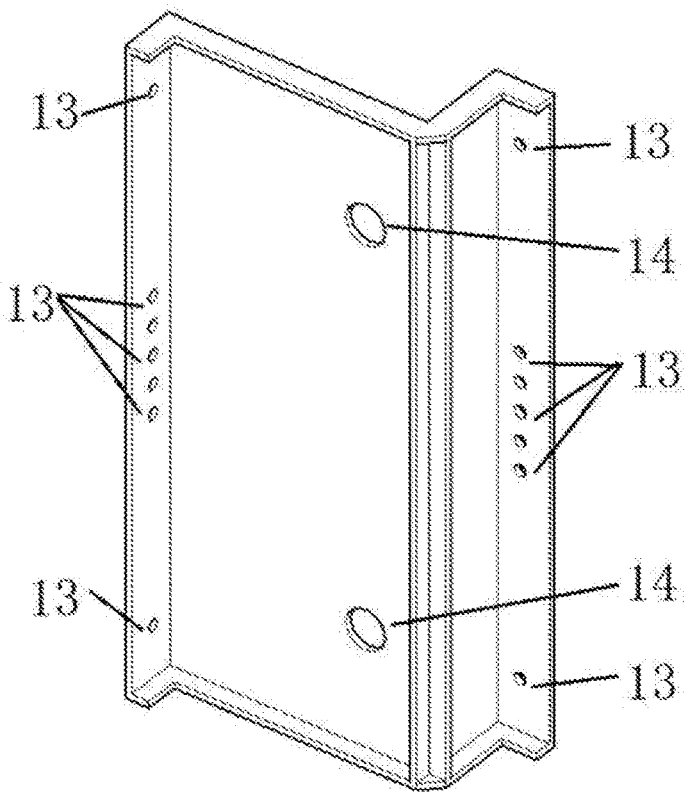
FIG. 8 is a schematic three-dimensional structural diagram of an upside module of an upper platform according to the present invention.
Figure 9:
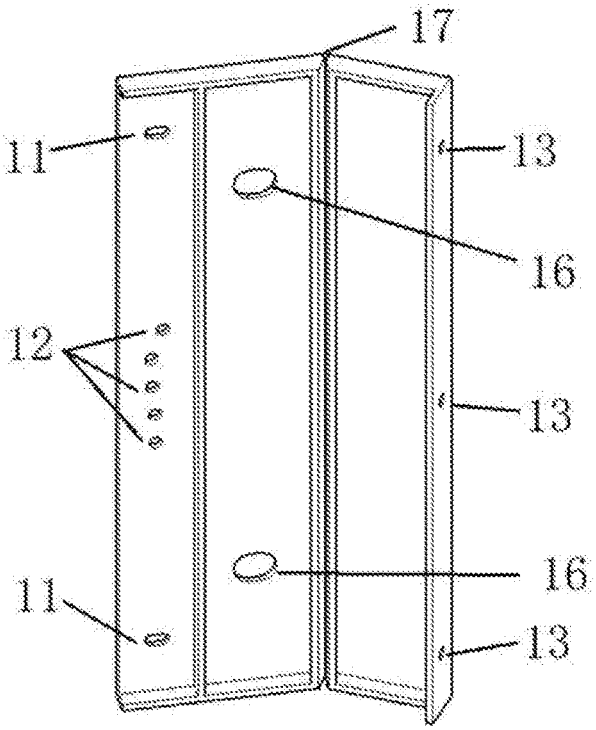
FIG. 9 is a schematic three-dimensional structural diagram of an underside rotating module of an upper platform according to the present invention.
Figure 10:
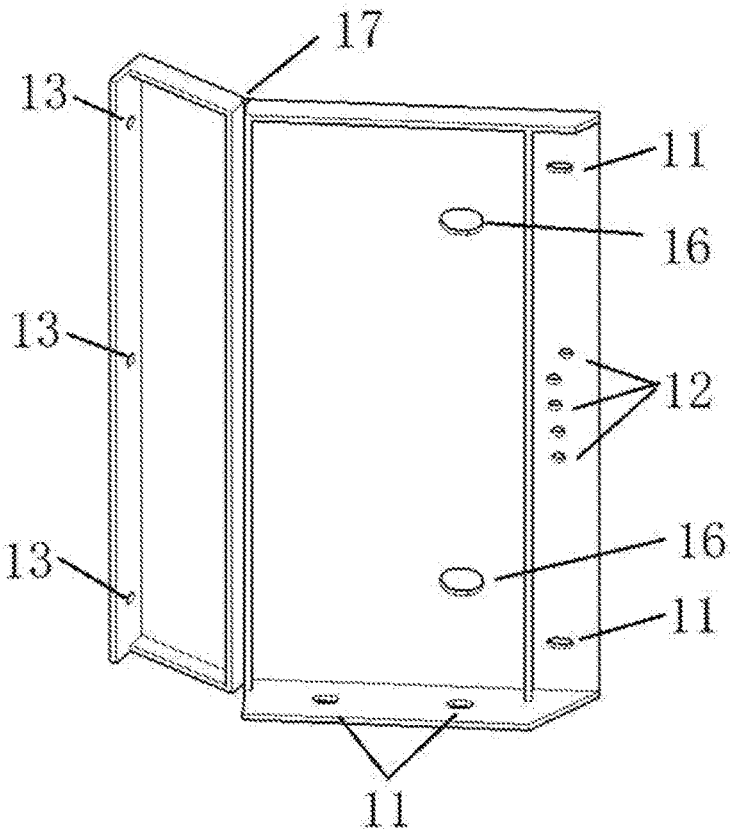
FIG. 10 is a schematic three-dimensional structural diagram of an underside rotating module of a lower platform according to the present invention.
Figure 11:
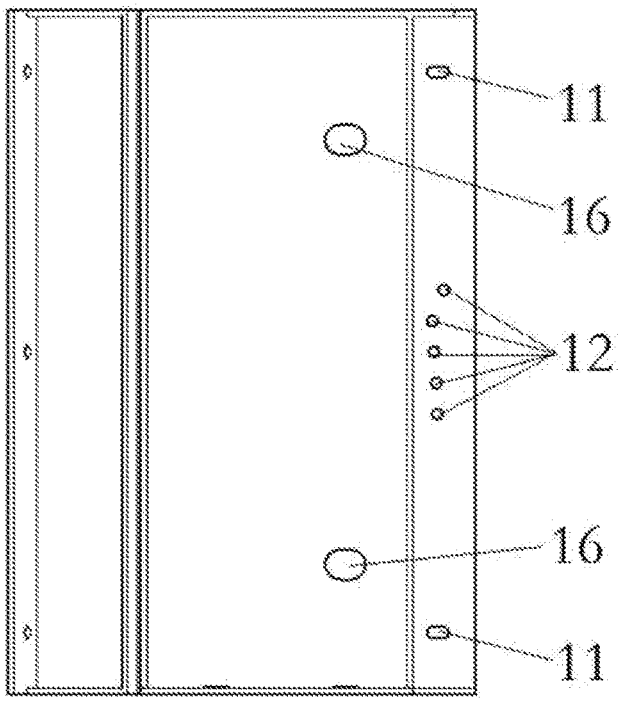
FIG. 11 is a schematic planar structural diagram of FIG. 10.
Figure 12:
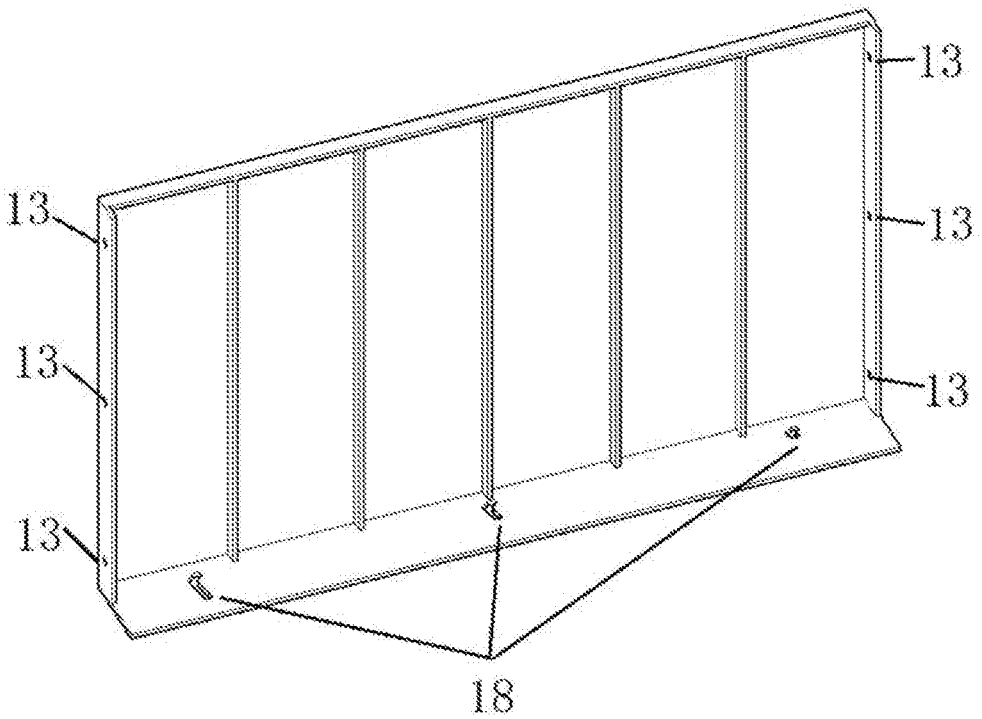
FIG. 12 is a schematic three-dimensional structural diagram of an underside common module according to the present invention.
Figure 13:
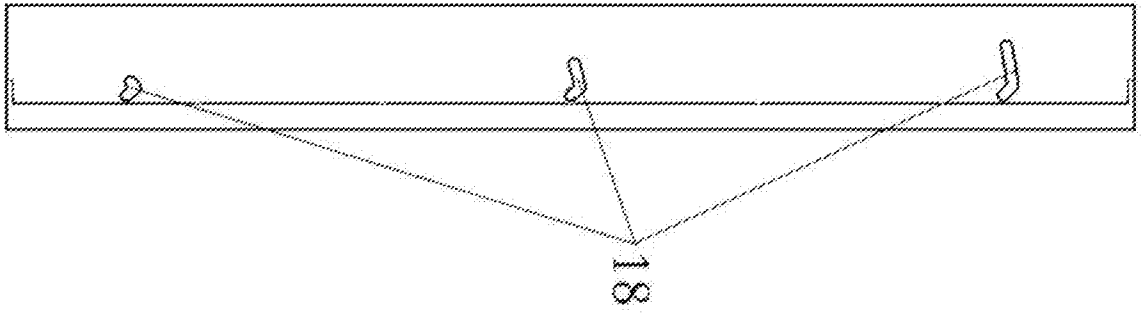
FIG. 13 is a schematic planar structural diagram of FIG. 12.

As shown in FIG. 1 to FIG. 13, a prefabricated stairs modular assembly mold includes a base 1, a step standard module 3, an upside module of a lower platform 2, an underside rotating module of a lower platform 6, an upside module of an upper platform 4, an underside rotating module of an upper platform 5, an underside common module 7, and an underside adjustment module 8; where fixing bolts for assembling the flight modules are provided on the base 1, and the upside module of the lower platform 2 is the flight module at the bottom, where several fixing holes 13 are provided on a side end-plate connected to the base 1, several locating holes 12 and sliding holes 11 are provided on a vertical end surface connected to the step standard module 3 above, and several fixing holes 13 are provided on a horizontal end surface connected to the lower platform underside rotating module 6;

for the lower platform underside rotating module 6, several sliding holes 11 are provided on a side end-plate connected to the base, several locating holes 12 and sliding holes 11 are provided on a horizontal end surface connected to the upside module of the lower platform 2, and several fixing holes 13 are provided on an end surface connected to the underside common module 7; and the underside rotating module of the lower platform 6 includes a horizontal fixing section and a sloping rotation section, where the horizontal fixing section and the sloping rotation section are hinged by using a rotating shaft 17;

for the step standard module 3, a sliding slot 15 is provided on a side end portion connected to the base, several fixing holes 13 are provided on a vertical end surface connected to the lower step standard module 3, and several locating holes 12 and sliding holes 11 are provided on a vertical end surface connected to the upper step standard module 3;

for the upside module of the upper platform 4, several fixing holes 13 are provided on a vertical end surface connected to the step standard module 3, and several fixing holes 13 are provided on a horizontal end surface connected to the lower underside rotating module of the upper platform 5;

for the underside rotating module of the upper platform 5, several locating holes 12 and sliding holes 11 are provided on a horizontal end surface connected to the upside module of the upper platform 4, and several fixing holes 13 are provided on an end surface connected to the underside adjustment module 8; and the upper platform underside rotating module 5 includes a horizontal fixing section and a sloping rotation section, where the horizontal fixing section and the sloping rotation section are hinged by using a rotating shaft 17; and the adjustment module 8 includes several sections of adjustment plates of different widths, and a length of an underside of the prefabricated stairs is adjusted through different splicing; and the common module 7 is a fixed-length module, and a curved sliding slot 18 is provided on a side end-plate connected to the base.

The upside module of the lower platform 2 determines a step stair dimension by using the locating holes, and is fixed to the upper step standard module 3 by using the sliding holes 11. The upside module of the lower platform 2 is connected to the base by using the side fixing holes 13 and is connected to the underside rotating module of the lower platform 6 by using the bottom fixing holes 13. The step standard module 3 determines a step stair dimension by using the locating holes 12, and is sequentially connected to the step standard modules 3 by using the sliding holes 11, where the step standard module can move along the sliding slot 15 and be fixed to the base 1 by using bolts. The upside module of the upper platform 4 is respectively connected to the step standard module 3 and the underside rotating module of the upper platform 5 by using fixing holes at two ends. The underside rotating module of the upper platform 5 determines a horizontal dimension of the upper platform underside by using locating holes 12, and is connected to the upside module of the upper platform 4. By rotating the rotating shaft 17, an angel between the upper platform horizontal plane and the flight incline may be adjusted, and the underside rotating module of the upper platform 5 is connected to the flight underside adjustment module 8 by using fixing holes 13. The underside rotating module of the lower platform 6 determines a horizontal dimension of the lower platform underside by using locating holes 12, and is connected to the base 1 and the lower platform upside module 2. An angel between the lower platform horizontal plane and the flight incline is adjusted by using the rotating shaft 17, and the underside rotating module of the lower platform 6 is connected to the flight underside common module 7 by using fixing holes 13. The flight underside common module 7 is respectively connected to the underside rotating module of the lower platform 6 and the flight underside adjustment module 8 by using the fixing holes 13 on two sides, moving and rotation of the flight underside common module 7 are implemented by using the curved sliding slots, and the flight underside common module 7 is fixed to the base 1 by using bolts.

As shown in FIG. 1 to FIG. 3, FIG. 5, and FIG. 8 to FIG. 11, horizontal end surfaces of both the upside module of the lower platform 2 and the upside module of the upper platform 4 are provided with reserved holes 14, a sliding reserved hole 16 is provided on a position that is on the horizontal end surface of the underside rotating module of the lower platform 6 and that corresponds to the reserved hole 14 on the upside module of the lower platform 2, a sliding reserved hole 16 is provided on a position that is on the horizontal end surface of the underside rotating module of the upper platform 5 and that corresponds to the reserved hole 14 on the upside module the upper platform 4; and a pin reserved hole module 9 is provided on the reserved hole between the upside module of the lower platform 2 and the underside rotating module of the lower platform 6, and a pin reserved hole module 9 is provided on the reserved hole between the upside module of the upper platform 4 and the underside rotating module of the upper platform 5.

The pin reserved hole module 9 is configured to form assembling key slot during vertical casting.

Further, the locating holes 12 of different heights on the upside module of the lower platform 2, the step standard module 3, the underside rotating module of the upper platform 5, and the underside rotating module of the lower platform 6 respectively correspond to stair dimensions of different specifications, the sliding holes 11 are oblong holes provided on two sides of the locating holes 12, and a distance between two circle centers of two ends of the oblong hole is greater than or equal to a height difference between the highest locating hole and the lowest locating hole.

For prefabricated stairs of different stair specifications, locating holes 12 of different heights are selected for positioning, and then sliding holes 11 at the two ends are used for assembling and fixing.

Further, a radian and a length of each curved sliding slot 18 on the underside common module 7 are determined according to a moving path of the underside common module 7.

An assembling method of a prefabricated stairs modular assembly mold includes the following steps:

step one: fixing a side end-plate of an upside module of a lower platform 2 to a base 1 by using bolts 10;

step two: selecting, according to a selected specification, locating holes with different stair dimensions, sequentially connecting step standard modules 3 from bottom to top, determining a quantity of the step standard modules 3 according to a dimension of fabricated stairs, and fixing a side end-plate of the base 1 of the step standard modules 3 to the base by using bolts 10;

step three: selecting a uniform stair dimension according to the locating hole on the step standard module 3, and fixedly connecting an upside module of an upper platform 4 to the last level of step standard module 3 by using bolts 10;

step four: fixedly connecting the upside module of the upper platform 4 to an underside rotating module of an upper platform 5 according to the locating hole on the underside rotating module of the upper platform 5 by using bolts 10;

step five: fixing an underside rotating module of a lower platform 6 to the upside module of the lower platform 2 according to the locating hole on the upside module of the lower platform 2 by using bolts 10, and fixing a side end-plate of the underside rotating module 6 to the base by using bolts 10;

step six: connecting a flight underside common module 7 to the underside rotating module of the lower platform 6 by using bolts 10;

step seven: selecting a corresponding quantity of flight underside adjustment modules 8 according to a stairs dimension and sequentially connecting the flight underside adjustment modules 8, where the underside adjustment module 8 at the top is fixedly connected to the underside rotating module of the upper platform 5 by using bolts 10, and the underside adjustment module 8 at the bottom is fixedly connected to the underside common module 7 by using bolts 10;

step eight: adjusting an angle by using the underside rotating module of the upper platform 5 and the underside rotating module of the lower platform 6, determining positions of the flight underside common module 7 and the flight underside adjustment modules 8, and fixing the underside common module 7 to the base by using bolts 10; and step nine: respectively fixing four pin reserved hole modules 9 to holes on the upside module of the lower platform 2 and the upside module of the upper platform 4.

What is claimed is:

1. A prefabricated stairs modular assembly mold, comprising a base, a step standard module, an upside module of a lower platform, an underside rotating module of a lower platform, an upside module of an upper platform, an underside rotating module of an upper platform, an underside common module, and an underside adjustment module, wherein fixing bolts for assembling flight modules comprising the step standard module, the upside module of the lower platform, the underside rotating module of the lower platform, the upside module of the upper platform, the underside rotating module of the upper platform, the underside common module, and the underside adjustment module are provided on the base, and the upside module of the lower platform is a bottom flight modules among the flight modules, wherein several fixing holes are provided on a side end-plate of the upside module of the lower platform connected to the base, several locating holes and sliding holes are provided on a vertical end surface of the upside module of the lower platform connected to the step standard module, and several fixing holes are provided on a horizontal end surface of the upside module of the lower platform connected to the underside rotating module of the lower platform;

for the underside rotating module of the lower platform, several sliding holes are provided on a side end-plate connected to the base, several locating holes and sliding holes are provided on a horizontal end surface connected to the upside module of the lower platform, and several fixing holes are provided on an end surface connected to the underside common module; and the underside rotating module of the lower platform comprises a horizontal fixing section and a sloping rotation section, wherein the horizontal fixing section and the sloping rotation section are hinged by using a rotating shaft;

for the step standard module, a sliding slot is provided on a side end portion connected to the base, several fixing holes are provided on a vertical end surface connected to a lower step standard module, and several locating holes and sliding holes are provided on a vertical end surface connected to an upper step standard module;

for the upside module of the upper platform, several fixing holes are provided on a vertical end surface connected to the step standard module, and several fixing holes are provided on a horizontal end surface connected to the underside rotating module of the upper platform;

for the underside rotating module of the upper platform, several locating holes and sliding holes are provided on a horizontal end surface connected to the upside module of the upper platform, and several fixing holes are provided on an end surface connected to the underside adjustment module; and the upper platform underside rotating module comprises a horizontal fixing section and a sloping rotation section, the horizontal fixing section and the sloping rotation section are hinged by using a rotating shaft; and the adjustment module comprises several sections of adjustment plates of different widths, and a length of an underside of the prefabricated stairs is adjusted through different splicing; and the common module is a fixed-length module, and a curved sliding slot is provided on a side end-plate of the common module connected to the base.

2. The prefabricated stairs modular assembly mold according to claim 1, wherein horizontal end surfaces of both the upside module of the lower platform and the upside module of the upper platform are provided with reserved holes, a sliding reserved hole is provided on a position that is on the horizontal end surface of the underside rotating module of the lower platform and that corresponds to the reserved hole on the upside module of the lower platform, a sliding reserved hole is provided on a position that is on the horizontal end surface of the underside rotating module of the upper platform and that corresponds to the reserved hole on the upside module of the upper platform; and a pin reserved hole module is provided on the reserved hole between the upside module of the lower platform and the underside rotating module of the lower platform, and a pin reserved hole module is provided on the reserved hole between the upside module of the upper platform and the underside rotating module of the upper platform.

3. The prefabricated stairs modular assembly mold according to claim 2, wherein the locating holes on each of the upside module of the lower platform, the step standard module, the underside rotating module of the upper platform, and the underside rotating module of the lower platform are positioned at different height levels, the sliding holes on each of the upside module of the lower platform, the step standard module, the underside rotating module of the upper platform, and the underside rotating module of the lower platform are oblong holes provided on two sides of corresponding locating holes, and a distance between circle centers of two ends of the oblong hole is greater than or equal to a height difference between a highest locating hole and a lowest locating hole of the corresponding locating holes.

4. The prefabricated stairs modular assembly mold according to claim 1, wherein a radian and a length of the curved sliding slot on the underside common module are determined according to a moving path of the underside common module.

5. The prefabricated stairs modular assembly mold according to claim 2, wherein a radian and a length of the curved sliding slot on the underside common module are determined according to a moving path of the underside common module.

6. The prefabricated stairs modular assembly mold according to claim 3, wherein a radian and a length of the curved sliding slot on the underside common module are determined according to a moving path of the underside common module.

7. An assembling method of a prefabricated stairs modular assembly mold, comprising the following steps:

step one: fixing a side end-plate of a upside module of a lower platform to a base by using bolts;

step two: selecting, according to a selected specification, locating holes of different for determining stair dimensions on a step standard modules, sequentially connecting the step standard modules from bottom to top and positioning the step standard modules by using the selected locating holes of the step standard modules, determining a quantity of the step standard modules according to a dimension of fabricated stairs, and fixing a side end-plate of each of the step standard modules to the base by using bolts;

step three: selecting a locating hole on an upside module of an upper platform based on a uniform stairs dimension according to the selected locating holes on the step standard modules, and fixedly connecting the upside module of the upper platform to a last level of the step standard module by using bolts and positioning the upside module of the upper platform by using the selected locating hole on the upside module of the upper platform;

step four: fixedly connecting the upside module of the upper platform to an underside rotating module of an upper platform by using bolts and positioning the underside rotating module of the upper platform by using a selected locating hole on the underside rotating module of the upper platform according to the uniform stairs dimension;

step five: fixing an underside rotating module of a lower platform to the upside module of the lower platform by using bolts and positioning the underside rotating module of the lower platform by using a selected locating hole on upside module of the lower platform according to the uniform stairs dimension, and fixing a side end-plate of the underside rotating module of the lower platform to the base by using bolts;

step six: connecting a flight underside common module to the underside rotating module of the lower platform by using bolts;

step seven: selecting a corresponding quantity of flight underside adjustment modules according to the dimension of fabricated stairs and sequentially connecting the flight underside adjustment modules, wherein the flight underside adjustment module at top is fixedly connected to the underside rotating module of the upper platform by using bolts, and the flight underside adjustment module at bottom is fixedly connected to the flight underside common module by using bolts;

step eight: adjusting an angle by using the underside rotating module of the upper platform and the underside rotating module of the lower platform, determining positions of the flight underside common module and the flight underside adjustment modules, and fixing the flight underside common module to the base by using bolts; and step nine: respectively fixing four pin reserved hole modules to holes on the upside module of the lower platform and the upside module of the upper platform.

* * * * *